US011380973B2

(12) United States Patent
Li et al.

(10) Patent No.: US 11,380,973 B2
(45) Date of Patent: Jul. 5, 2022

(54) CAVITY-BASED DUAL-BAND FILTERING BALUN

(71) Applicant: SOUTH CHINA UNIVERSITY OF TECHNOLOGY, Guangdong (CN)

(72) Inventors: Yuanchun Li, Guangdong (CN); Xin Fang, Guangdong (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 261 days.

(21) Appl. No.: 16/627,764

(22) PCT Filed: Oct. 30, 2018

(86) PCT No.: PCT/CN2018/112822
§ 371 (c)(1),
(2) Date: Dec. 31, 2019

(87) PCT Pub. No.: WO2020/000822
PCT Pub. Date: Jan. 2, 2020

(65) Prior Publication Data

US 2021/0384604 A1 Dec. 9, 2021

(30) Foreign Application Priority Data

Jun. 27, 2018 (CN) ..... 201810676821.5

(51) Int. Cl.
*H01P 5/10* (2006.01)
*H01P 1/208* (2006.01)

(52) U.S. Cl.
CPC ..... *H01P 5/1007* (2013.01); *H01P 1/208* (2013.01)

(58) Field of Classification Search
CPC ..... H01P 5/1007; H01P 1/208
(Continued)

(56) References Cited

U.S. PATENT DOCUMENTS

2008/0224791 A1 9/2008 Cheng
2018/0090803 A1* 3/2018 Elsherbini ..... H01P 5/1007

FOREIGN PATENT DOCUMENTS

CN 103531874 1/2014
CN 108306082 7/2018

OTHER PUBLICATIONS

Qing-Yi Guo, et al., "Bandpass Class-F Power Amplifier Based on Multifunction Hybrid Cavity-Microstrip Filter." IEEE Transactions on Circuits and Systems II: Express Briefs, vol. 64, No. 7, Aug. 16, 2016, pp. 742-746.

(Continued)

*Primary Examiner* — Rakesh B Patel
*Assistant Examiner* — Jorge L Salazar, Jr.
(74) *Attorney, Agent, or Firm* — JCIPRNET

(57) ABSTRACT

The invention discloses a cavity-based dual-band filtering balun, which includes a first cavity resonator and a second cavity resonator which are connected by a metal plate, the first cavity resonator is provided with an input PCB board, a metal ground layer of the input PCB board is provided with an input through line, the other side of the input PCB board is provided with an input microstrip line, and the first cavity resonator is provided with an input slot corresponding to a position of the input through line; and two opposite outside surfaces of the second cavity resonator which are adjacent to the metal plate are each provided with an output PCB board, metal ground layers of the two output PCB boards are respectively provided with an output through line, the other sides of the two output PCB boards are each provided with an output microstrip line, and the second cavity resonator is provided with an output slot corresponding to a position of the output through line and communicated with the output through line. A main body of the dual-band filtering balun includes two cavity resonators, its structure is high in quality factor and low in insertion loss, and meanwhile, the require- (Continued)

ment of two passbands is realized by using two fundamental modes of the cavity resonators, thus reducing a size of a circuit.

10 Claims, 6 Drawing Sheets

(58) Field of Classification Search
USPC ..... 333/24 R
See application file for complete search history.

(56) References Cited

OTHER PUBLICATIONS

"International Search Report (Form PCT/ISA/210) of PCT/CN2018/112822," dated Feb. 27, 2019, pp. 1-4.

* cited by examiner

CAVITY-BASED DUAL-BAND FILTERING BALUN

CROSS-REFERENCE TO RELATED APPLICATION

This application is a 371 of international application of PCT application serial no. PCT/CN2018/112822, filed on Oct. 30, 2018, which claims the priority benefit of China application no. 201810676821.5, filed on Jun. 27, 2018. The entirety of each of the abovementioned patent applications is hereby incorporated by reference herein and made a part of this specification.

FIELD OF THE INVENTION

The present invention relates to the technical field of electromagnetic field and microwave, and more particularly, to a cavity-based dual-band filtering balun.

DESCRIPTION OF RELATED ART

In a modern wireless communication network, a balun serves as a key device in a radio-frequency power amplifier, and performances thereof affect the normal operation of the whole system function. A high-performance balun requires not only good filtering performance, low loss and miniaturization, but also requires a dual-band or even multiband filtering balun with the development of a dual-band and multiband communication system.

In recent years, significant progresses have been made in researches on the filtering balun, and the filtering balun has been realized in processing technologies such as printed circuit board, low-temperature co-fired ceramic technology, substrate integrated waveguide technology, dielectric resonator technology, etc. However, the researched filtering baluns have some performance defects such as low quality factors and large insertion losses. In addition, there are a few research results on the dual-band baluns, and currently, the dual-band function can be realized on the printed circuit board and the substrate integrated waveguide technology.

To sum up, the existing technology of the above-mentioned dual-band filtering balun is limited by various aspects in practice.

BRIEF SUMMARY OF THE INVENTION

Aiming at the defects in the prior arts, the present invention provides a cavity-based dual-band filtering balun. A cavity resonator technology is used in the dual-band filtering balun of the present invention, which increases quality factors and reduces insertion loss, and meanwhile, two resonant modes in a cavity resonator are used to realize the requirement of dual-band filtering balun.

In order to solve the above technical problem, the present invention adopts at least one of the following technical solutions.

A cavity-based dual-band filtering balun comprises a cavity resonator, the cavity resonator is divided into a first cavity resonator and a second cavity resonator by an intermediate metal plate, edges of the intermediate metal plate are connected to inner walls of the cavity resonator, an outer side wall of the first cavity resonator that faces the intermediate metal plate is provided with an input PCB board, and a metal ground layer of the input PCB board is contacted with the first cavity resonator. The metal ground layer of the input PCB board is provided with an input through line, the other side, namely a top layer, of the input PCB board is provided with an input microstrip line, and one side of the first cavity resonator contacted with the input PCB board is provided with an input slot completely corresponding to a position of the input through line and communicated with the input through line. Two opposite outside surfaces of the second cavity resonator that are adjacent to the intermediate metal plate are each provided with an output PCB board, and the metal ground layers of the two output PCB boards are close to the outside surfaces of the second cavity resonator. The metal ground layers of two output PCB boards (11) are respectively provided with an output through line, the other sides, namely top layers, of the two output PCB boards are each provided with an output microstrip line, and two sides of the second cavity resonator that are close to the output PCB boards are respectively provided with an output slot completely corresponding to a position of the output through line and communicated with the output through line.

The input microstrip line and the input through line are used for signal input, and the input PCB board, the input through line and the input microstrip line form an input feed network. The input slot is used to transmit a signal into the cavity resonator from the input microstrip line to generate resonance. The output PCB board, the output through line and the output microstrip line form an output feed network. Two output slots are used to transmit signals to an output PCB feed network from the cavity resonator.

Further, the intermediate metal plate includes a metal partition plate and a rectangular slit opened in the metal partition plate, the rectangular slit is parallel to the input through line and the input slot, and in this way, all input signals can be coupled to the second cavity resonator from the first cavity resonator. Two output through lines are provided, which are respectively a first output through line and a second output through line. Two output slots are provided, which are respectively a first output slot and a second output slot. The first output through line is parallel to the first output slot, the second output through line is parallel to the second output slot, and the first output through line and the first output slot are parallel to the second output through line and second output slot. Two output microstrip lines are provided, which are respectively a first output microstrip line and a second output microstrip line, and the first output microstrip line is central symmetry with the second output microstrip line. Two output PCB boards are provided, which are respectively a first output PCB board and a second output PCB board, and form an output feed network.

Further, the input dielectric substrate of the input PCB board has a dielectric constant of 2.55.

Further, the first output PCB board includes a first output dielectric substrate, a first output metal ground layer and the first output microstrip line, and the output through line is arranged on the first output metal ground layer. The second output PCB board includes a second output dielectric substrate, a second output metal ground layer and the second output microstrip line, and the output through line is arranged on the second output metal ground layer.

Further, both of the first output dielectric substrate and the second output dielectric substrate have a dielectric constant of 2.55.

Further, the input through line is inclined at an included angle $\theta_1$ to a horizontal direction, and a center of the through line is located at a center of the input PCB board, such that multiple modes can be fed by controlling the inclination angle of the input through line to meet the requirement of dual-band signals for the dual-band filtering balun. The first output through line and the second output through line are both inclined at an included angle $\theta_2$ to the horizontal direction, and the first output through line deviates upwardly from a center position of the first output PCB board, the second output trough line deviates downwardly from a center position of the second output PCB board, and the first output through line and the second output through line deviate by a same distance, such that the output through lines can receive signals of multiple modes with equal amplitudes.

Further, the input microstrip line is located at a middle position of the input PCB board, one end of the input microstrip line is flush with a bottom end edge of the input PCB board, and the other end of the input microstrip line extends upwardly along a vertical direction to be staggered with the input through line and passes over the input through line. One end of the first output microstrip line is flush with a bottom end edge of the first output PCB board, and the other end of the first output microstrip line extends upwardly along the vertical direction to be staggered with the first output through line and passes over the first output through line. One end of the second output microstrip line is flush with a top end edge of the second output PCB board, the other end of the second output microstrip line extends downwardly along the vertical direction to be staggered with the second output through line and passes over the second output through line, and the first output microstrip line is in central symmetry with the second output microstrip line. The output microstrip line can receive currents with reverse phase and equal amplitude, i.e., the output PCB board can output signals with reverse phase and equal amplitude.

Further, the rectangular slit of the intermediate metal plate is inclined at an included angle $\theta_1$ to a horizontal direction, and the input through line is parallel to the rectangular slit.

Further, a characteristic impedance of the input microstrip line and a characteristic impedance of the output microstrip lines are both 50Ω.

Further, the first cavity resonator, the second cavity resonator and the intermediate metal plate are made of silver-plated aluminums.

Further, the input slot with the same shape and size as the input through line is arranged at a corresponding position on one side of the first cavity resonator close to the input PCB board, and the input slot is used to transmit a signal into the cavity resonator from the input microstrip line to generate resonance.

Compared with the prior art, the present invention has the following advantages and beneficial effects.

According to the present invention, characteristics of resonant modes of the cavity resonator are used, and the signals with reverse phase and equal amplitude can be effectively excited and extracted by two output through lines.

According to the present invention, a microstrip feed mode is used, various modes can be excited by controlling the inclination angle of the input through line, the requirement of dual-band is realized by cavity-based structure, and the circuit size is reduced.

The filtering balun of the present invention not only can ensure a filtering characteristic but also has a balun capability of converting an imbalance signal into a balance signal, and the filtering balun also meets the characteristic of two passbands, and lower insertion loss, better passband selectivity, as well as accurate output signal with amplitude balance and phase difference.

DETAILED DESCRIPTION OF THE INVENTION

Figure 1:
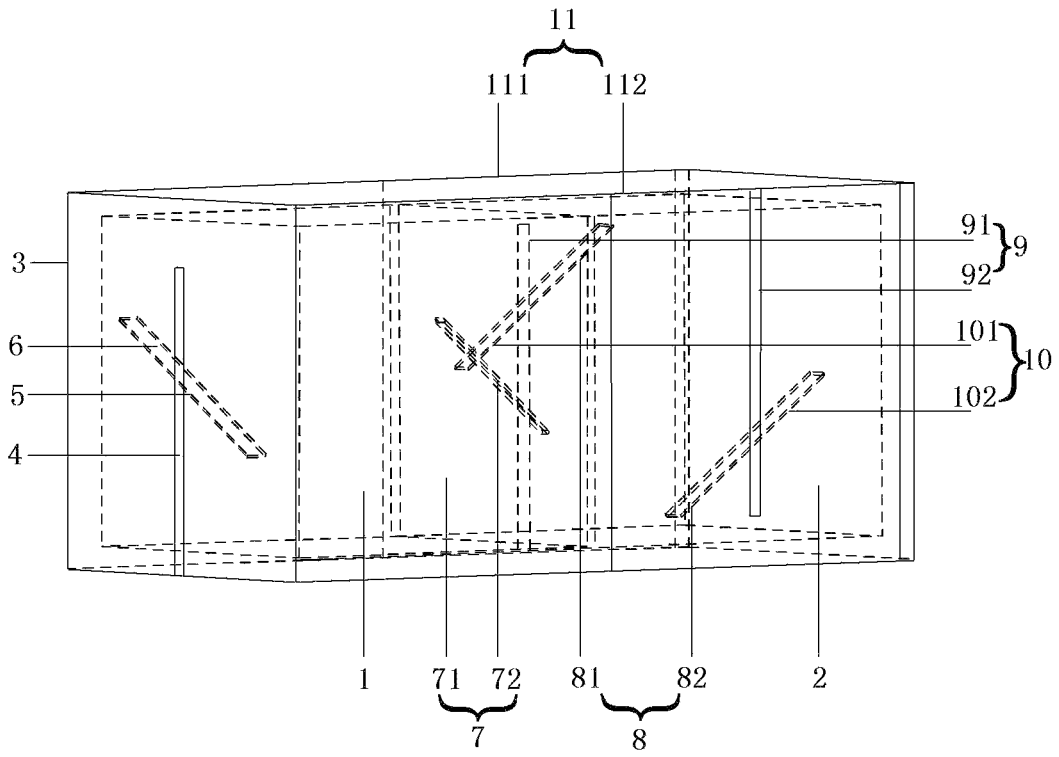
FIG. 1 is a schematic diagram of an overall structure of a cavity-based dual-band filtering balun in an embodiment.
Figure 2:
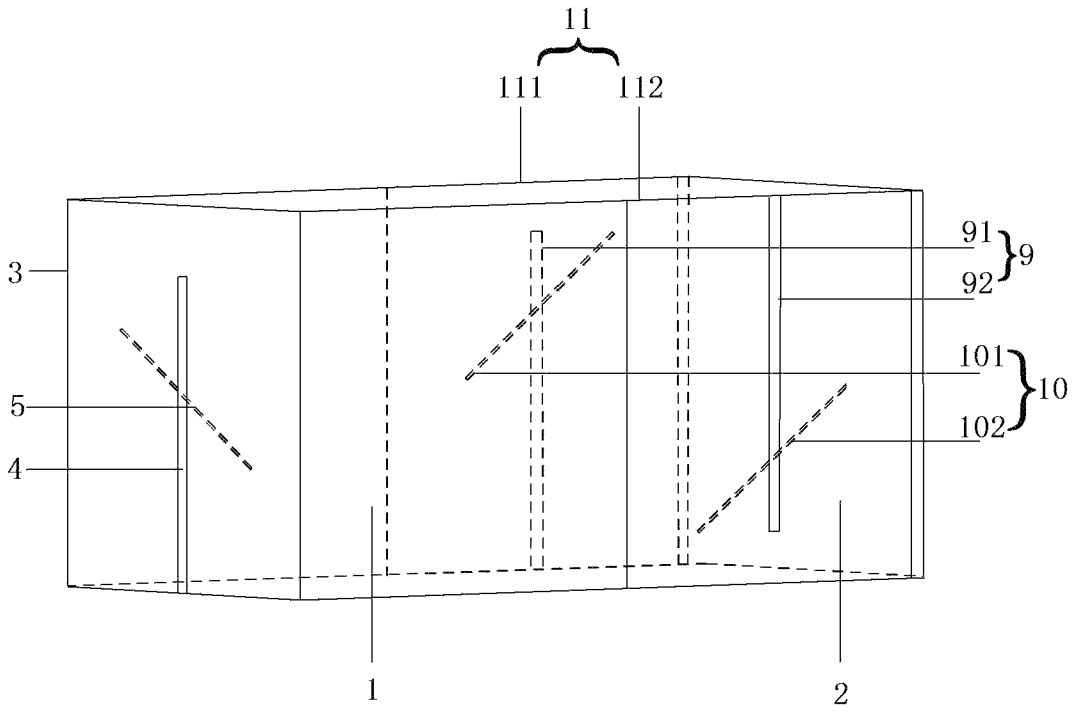
FIG. 2 is a schematic diagram of an external structure of a cavity-based dual-band filtering balun in an embodiment.
Figure 3:
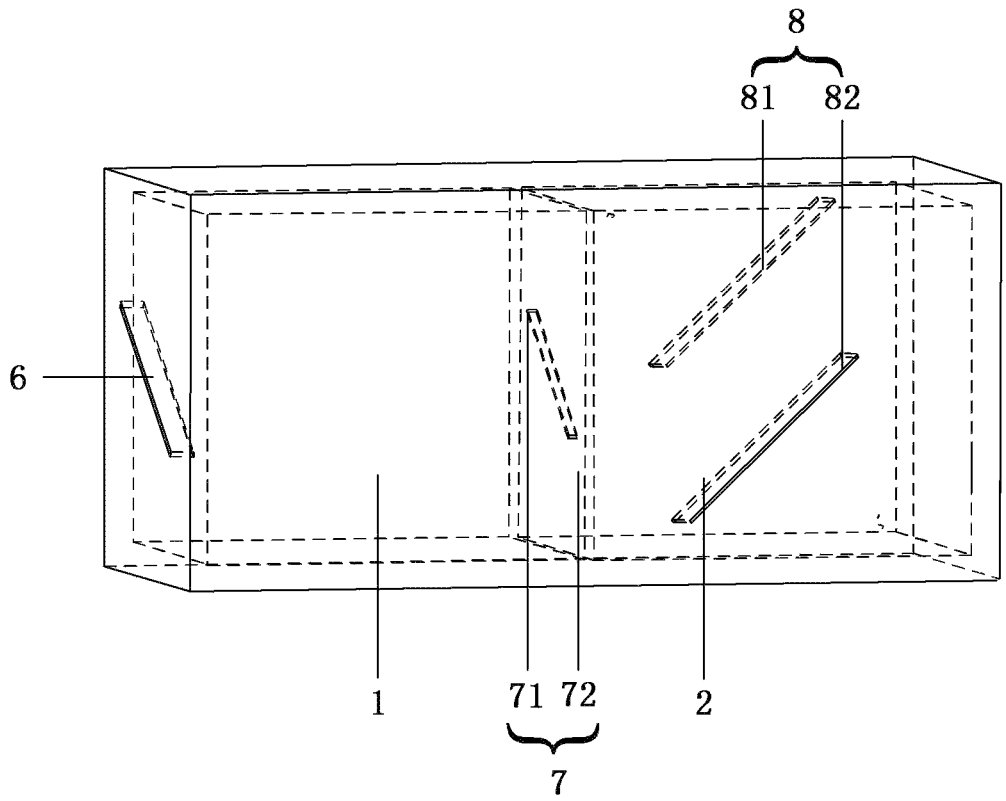
FIG. 3 is a structural schematic diagram of a cavity of a cavity-based dual-band filtering balun in an embodiment.
Figure 4:
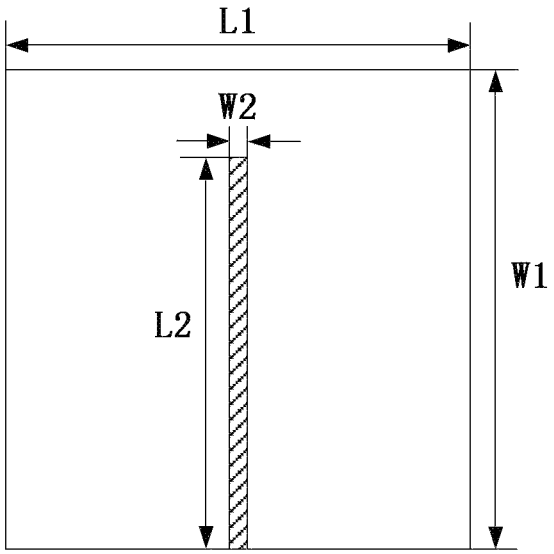
FIG. 4 is a structural schematic diagram of an outside surface of an input PCB board in an embodiment.
Figure 5:
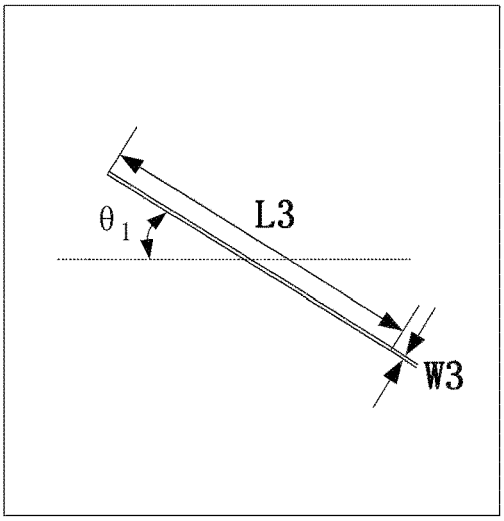
FIG. 5 is a structural schematic diagram of an inner side surface of an input PCB board in an embodiment.
Figure 6:
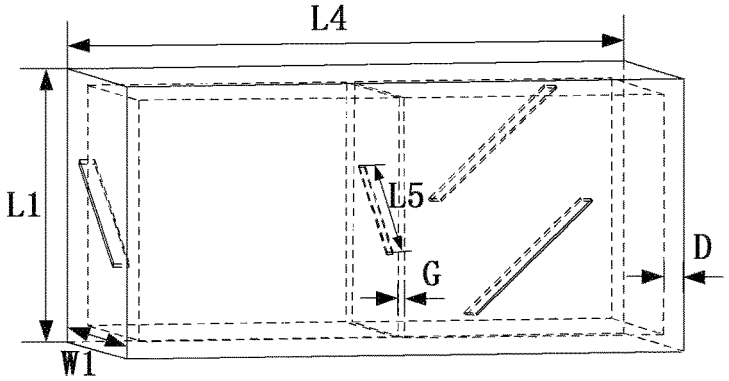
FIG. 6 is a structural schematic diagram of a cavity resonator in an embodiment.
Figure 7:
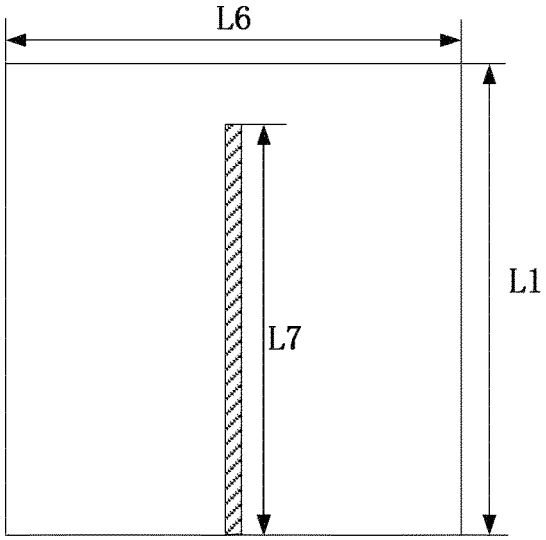
FIG. 7 is a structural schematic diagram of an outside surface of a first output PCB board in an embodiment.

The accompanying drawings are for illustrative purpose only and cannot be construed as limiting the patent. To better describe the embodiment, some parts can be omitted, enlarged or shrunk in the accompanying drawings, which does not represent the size of the actual product. It is understandable for those skilled in the art that some well-known structures in the accompanying drawings and the descriptions thereof may be omitted. The positional relationship illustrated in the accompanying drawings is for illustrative purpose only and cannot be construed as limiting the present invention.

A cavity-based dual-band filtering balun is shown in FIG. 1 to FIG. 7, which includes two cavity resonators, the first cavity resonator 1 is connected to the second cavity resonator 2 by an intermediate metal plate, one side of the first cavity resonator 1 which faces the intermediate metal plate 7 is provided with an input PCB board, one side of the input PCB board 3 that is attached to a side surface of the first cavity resonator 1 is provided with an input through line, the other side of the input PCB board 3 is provided with an input microstrip line, the input microstrip line 4 and the input through line 5 are used for signal input, and the input PCB board 3, the input through line 5 and the input microstrip line 4 form an input feed network. An input slot with the same shape and size as the input through line is arranged at a corresponding position on one side of the first cavity resonator close to the input PCB board, and the input slot 6 is used to transmit a signal into the first cavity resonator 1 from the input microstrip line 4 to generate resonance. Two opposite surfaces of the second cavity resonator 2 that are adjacent to the intermediate metal plate 7 are provided with two opposite output PCB boards, one sides of the two output PCB boards 11 attached to a side surface of the second cavity resonator 2 are respectively provided with an output through line, the other sides of the two output PCB boards 11 are each provided with an output microstrip line, and the output PCB board 11, the output through line 10 and the output microstrip line 9 form an output feeding network. Two sides of the second cavity resonator 2 close to the output PCB boards 11 are respectively provided with an output slot with the same shape and size as the output through line 10, and the two output slots 8 are used to transmit a signal to the output PCB feeding network from the second cavity resonator 2.

In the embodiment, one input through line 5 is provided, one input slot 6 is provided, the intermediate metal plate 7 includes a rectangular slit 72 and a metal partition plate 71, and the rectangular slit 72 is parallel to the input through line 5, such that all input signals can be coupled to the second cavity resonator 2 from the first cavity resonator 1. Two output through lines are provided, and the first output through line is parallel to the second output through line, such that the output through line can receive signals with equal amplitude. One input microstrip line is provided, two input microstrip lines are provided, and the first output microstrip line is in central symmetry with the second output microstrip line, such that the output microstrip line can receive currents with reverse phase and equal amplitude, that is, the output PCB board can output signals with reverse phase and equal amplitude. One input PCB board is provided, and two output PCB boards are provided, which are respectively a first output PCB 111 and a second output PCB 112, and form an output feed network.

In the embodiment, the input PCB board 3 includes an input dielectric substrate and an input port metal ground arranged on a side surface of one side of the input dielectric substrate close to the first cavity resonator 1, the input through line 5 is arranged on the input metal ground, and the input microstrip line 4 is arranged on a side surface of one side of the input dielectric substrate far away from the first cavity resonator 1. The first output PCB board 111 includes a first output dielectric substrate and a first output metal ground arranged on a side surface of one side of the first output dielectric substrate close to the second cavity resonator 2, the output through line 101 is arranged on the first output metal ground, and the first output microstrip line 91 is arranged on a side surface of one side of the first output dielectric substrate far away from the second cavity resonator 2. The second output PCB board 112 includes a second output dielectric substrate and a second output metal ground arranged on a side surface of one side of the second output dielectric substrate close to the second cavity resonator 2, the output through line 102 is arranged on the second output metal ground, and the second output microstrip line 92 is arranged on a side surface of one side of the second output dielectric substrate far away from the second cavity resonator. The input dielectric substrate and the output dielectric substrate both have a dielectric constant of 2.55.

As shown in FIG. 1 to FIG. 7, the input through line 5 is inclined at an included angle $\theta_1$ to a horizontal direction, such that multiple modes can be fed by controlling the inclination angle of the input through line 5 to meet the requirement of dual-band signals for double passbands. The first output through line 101 and the second output through line 102 are both inclined at an included angle $\theta_2$ to the horizontal direction, and the first output through line 101 deviates upwardly from a center position, and the second output through line 102 deviates downwardly from a center position, and the first output trough line 101 and the second output through line 102 deviate by the same distance. In this way, the output through line 10 can receive signals of multiple modes with equal amplitude.

As shown in FIG. 2 to FIG. 7, the input microstrip line 4 is located at a middle position of the input PCB board 3, one end of the input microstrip line 4 is flush with a bottom end edge of the input PCB board 3, and the other end of the input microstrip line 4 extends upwardly along a vertical direction to be staggered with the input through line 5 and passes over the input through line 5. One end of the first output microstrip line 91 is flush with a bottom end edge of the first output PCB board 111, and the other end of the first output microstrip line 91 extends upwardly along the vertical direction to be staggered with the first output through line 101 and passes over the first output through line 101. One end of the second output microstrip line 92 is flush with a top end edge of the second output PCB board 112, and the other end of the second output microstrip line 92 extends downwardly along the vertical direction to be staggered with the second output through line 102 and passes over the second output through line 102.

In the embodiment, a characteristic impedance of the input microstrip line 4 and a characteristic impedance of the output microstrip lines are both 50Ω.

In the embodiment, the first cavity resonator 1, the second cavity resonator 2 and the intermediate metal plate 7 are made of silver-plated aluminum.

As shown in FIG. 2 to FIG. 7, simulation and testing were performed on the filtering balun in the embodiment with various parameters as follows: the input PCB board 3 had a length L1 of 64.5 mm and a width W1 of 66.7 mm, and the output PCB board 11 had a width L6 of 64.6 mm; the input microstrip line 4 had a length L2 of 51.3 mm and a width W2 of 2.3 mm; the output microstrip line 9 had a length L7 of 58 mm; the input trough line 5 had a length L3 of 43.5 mm, the input microstrip line had a width W3 of 0.5 mm, the output through line 10 had a length L8 of 40.5 mm, and the output through line had a width W4 of 0.5 mm; two cavity resonators 1, 2 had a total height L4 of 138.5 mm; the input through line 5 had an included angle $\theta_1$ of 32° to the horizontal direction, and the output through line 10 had an included angle $\theta_2$ of 37° to the horizontal direction; the output through line deviated from the center position by a distance L9 of 12 mm; the intermediate metal plate 7 between the two cavity resonators had a thickness G of 1.5 mm, the rectangular slit had a length L5 of 35.9 mm and a width W5 of 0.6 mm, the two cavity resonators 1, 2 had a wall thickness D of 4 mm, and the two cavity resonators 1, 2 were made of silver-plated aluminum; and the input dielectric substrate and the two output dielectric substrates had a relative dielectric constant Er of 2.55, a thickness of 0.762 mm, and a dielectric loss tangent tan of 0.0015. The test results are shown in FIG. 8 and FIG. 9.

Figure 8:
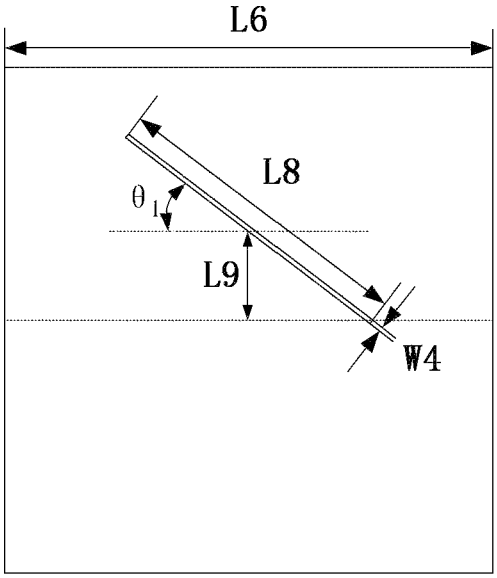
FIG. 8 is a structural schematic diagram of an inner side surface of a first output PCB board in an embodiment.
Figure 9:
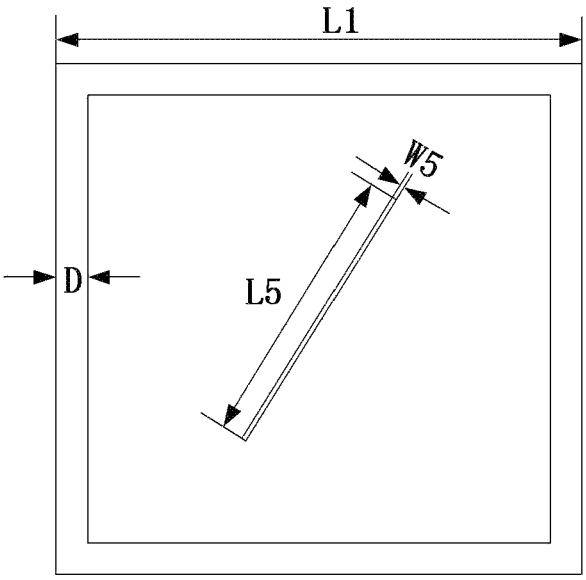
FIG. 9 is a structural schematic diagram of an intermediate metal plate in an embodiment.
Figure 10:
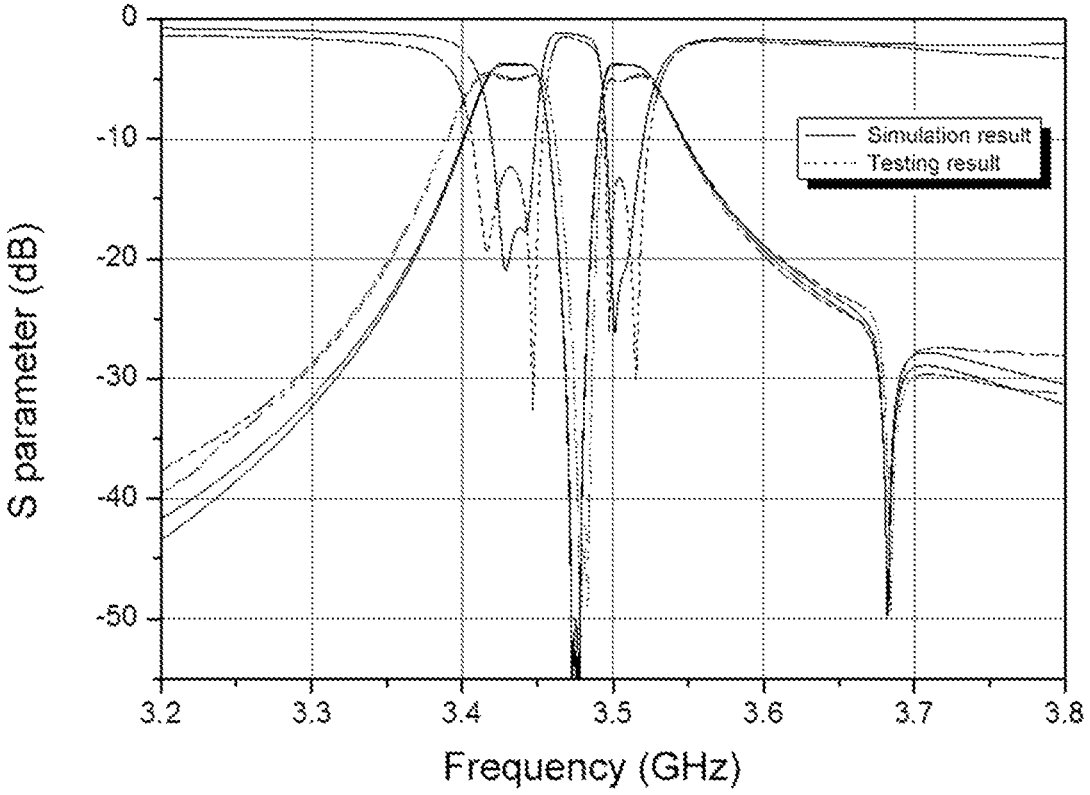
FIG. 10 is a comparison diagram of S parameters in simulation and testing of a filtering balun embodiment in an embodiment.
Figure 11:
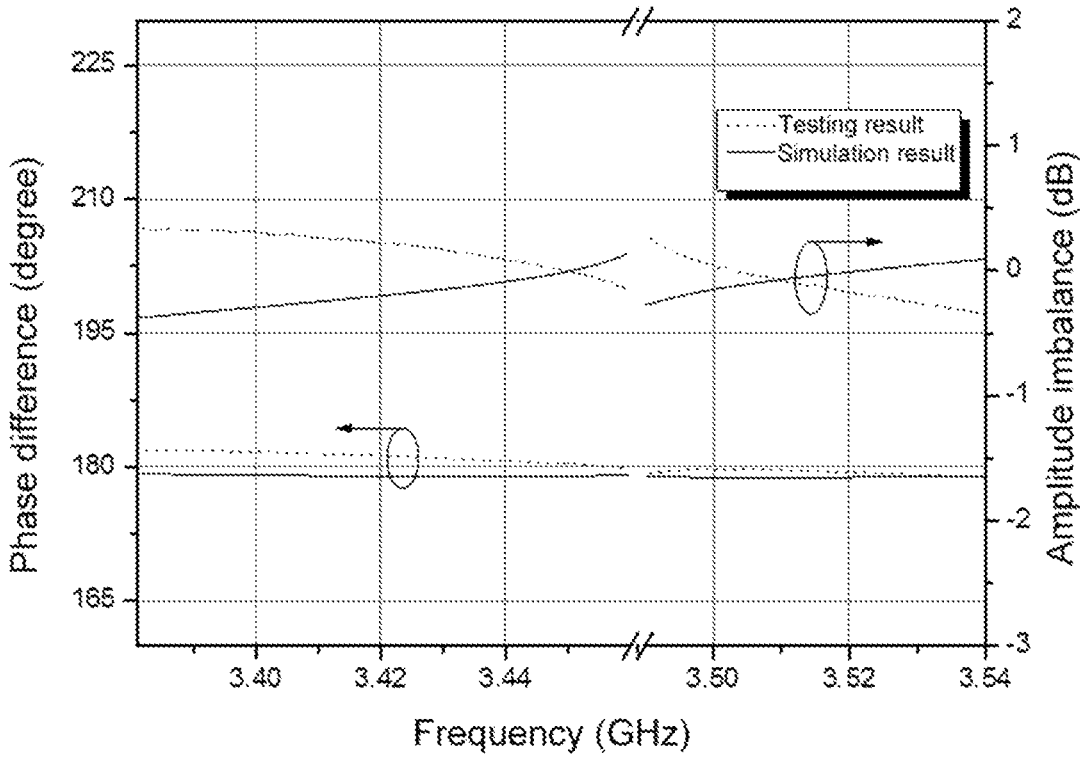
FIG. 11 is a curve graph of a balance characteristic of output ports in the dual-band filtering balun embodiment in an embodiment.

FIG. 8 includes three curves S11, S21 and S31. The dual-band filtering balun was operated at 3.43 G and 3.52 G. A first pass band had a 3 dB relative bandwidth of about 1.84%, a minimum insertion loss was (3+1.5) dB, a return loss in the passband was about 12.3 dB, and a transmission zero was provided close to a lower side frequency of the first pass band, so that the selectivity of the passband was better. A second passband had a 3 dB relative bandwidth of about 1.34%, a minimum insertion loss was (3+1.65) dB, a return loss in the passband was about 13.2 dB, and a transmission zero was provided close to a lower side frequency of the second passband, so that the selectivity of the pass band was better. FIG. 9 illustrates a good amplitude balance and phase difference characteristic between two output ports in two passbands of the filtering balun. Thus, it can be seen that an amplitude imbalance between the two output ports in the two passbands was less than 0.31 dB, and a phase difference was controlled within a range of 180±1.7°.

Obviously, the above embodiment of the present invention is only example for clearly describing the present invention, and doesn't limit the implementation of the present invention. For those having ordinary skills in the art, other different forms of changes or variations can also be made on the basis of the description above. All implementations need not and cannot be exhaustive here. All modifications, equivalents, and improvements made within the spirit and principle of the present invention shall be included within the scope of protection of the claims of the present invention.

What is claimed is:

1. A cavity-based dual-band filtering balun, wherein the filtering balun comprises a cavity resonator, the cavity resonator is divided into a first cavity resonator and a second cavity resonator by an intermediate metal plate, edges of the intermediate metal plate are connected to inner walls of the cavity resonator, an outside wall of the first cavity resonator that faces the intermediate metal plate is provided with an input PCB board, and a metal ground layer of the input PCB board is in contact with the first cavity resonator; the metal ground layer on one side of the input PCB board is provided with an input through line, the other side of the input PCB board which is a top layer is provided with an input microstrip line, and one side of the first cavity resonator which is in contact with the input PCB board is provided with an input slot corresponding to a position of the input through line and communicated with the input through line; two opposite outside surfaces of the second cavity resonator that are adjacent to the intermediate metal plate are each provided with an output PCB board, and metal ground layers of the two output PCB boards are close to side surfaces of the second cavity resonator; the metal ground layers of the two output PCB boards are respectively provided with an output through line, the other sides of the two output PCB boards which are top layers are each provided with an output microstrip line, and two sides of the second cavity resonator that are close to the output PCB boards are respectively provided with an output slot corresponding to a position of the output through line and communicated with the output through line.

2. The cavity-based dual-band filtering balun according to claim 1, wherein the intermediate metal plate comprises a metal partition plate and a rectangular slit opened in the metal partition plate, and the rectangular slit is parallel to the input through line and the input slot; the two output through lines are provided, which are respectively a first output through line and a second output through line, two output slots are provided, which are respectively a first output slot and a second output slot, the first output through line is parallel to the first output slot, the second output through line is parallel to the second output slot, and the first output through line and the first output slot are parallel to the second output through line and second output slot; two output microstrip lines are provided, which are respectively a first output microstrip line and a second output microstrip line, and the first output microstrip line is in central symmetry with the second output microstrip line; and two output PCB boards are provided, which are respectively a first output PCB board and a second output PCB board.

3. The cavity-based dual-band filtering balun according to claim 2, wherein an input dielectric substrate of the input PCB board has a dielectric constant of 2.55.

4. The cavity-based dual-band filtering balun according to claim 2, wherein the first output PCB board comprises a first output dielectric substrate, a first output metal ground layer and the first output microstrip line, and the first output through line is arranged on the first output metal ground layer; and the second output PCB board comprises a second output dielectric substrate, a second output metal ground layer and the second output microstrip line, and the second output through line is arranged on the second output metal ground layer.

5. The cavity-based dual-band filtering balun according to claim 4, wherein both the first output dielectric substrate and the second output dielectric substrate have a dielectric constant of 2.55.

6. The cavity-based dual-band filtering balun according to claim 2, wherein the input through line is inclined at an included angle $\theta_1$ to a horizontal direction; and the first output through line and the second output through line are both inclined at an included angle $\theta_2$ to the horizontal direction, the first output through line deviates upwardly from a center position of the first output PCB board, the second output through line deviates downwardly from a center position of the second output PCB board, and the first output through line and the second output through line deviate by a same distance.

7. The cavity-based dual-band filtering balun according to claim 2, wherein the input microstrip line is located at a middle position of the input PCB board, one end of the input microstrip line is flush with a bottom end edge of the input PCB board, and the other end of the input microstrip line extends upwardly along a vertical direction to be staggered with the input through line and passes over the input through line; one end of the first output microstrip line is flush with a bottom end edge of the first output PCB board, and the other end of the first output microstrip line extends upwardly along the vertical direction to be staggered with the first output through line and passes over the first output through line; and one end of the second output microstrip line is flush with a top end edge of the second output PCB board, the other end of the second output microstrip line extends downwardly along the vertical direction to be staggered with the second output through line and passes over the second output through line, and the first output microstrip line is in central symmetry with the second output microstrip line.

8. The cavity-based dual-band filtering balun according to claim 2, wherein the rectangular slit of the intermediate metal plate is inclined at an included angle $\theta_1$ to a horizontal direction, and the input through line is parallel to the rectangular slit.

9. The cavity-based dual-band filtering balun according to claim 1, wherein a characteristic impedance of the input microstrip line and a characteristic impedance of the output microstrip line are both 50Ω.

10. The cavity-based dual-band filtering balun according to claim 1, wherein the first cavity resonator, the second cavity resonator and the intermediate metal plate are made of a silver-plated aluminum substrate.

* * * * *